United States Patent [19]

Stahlecker

[11] 4,059,947

[45] Nov. 29, 1977

[54] OPEN-END SPINNING UNIT

[75] Inventor: Gerd Stahlecker, Bad Uberkingen, Germany

[73] Assignees: Fritz Stahlecker; Hans Stahlecker, both of Germany

[21] Appl. No.: 623,474

[22] Filed: Oct. 17, 1975

[30] Foreign Application Priority Data

Oct. 30, 1974 Germany ..... 2451551

[51] Int. Cl.[2] ..... D01H 1/12

[52] U.S. Cl. ..... 57/58.89; 57/58.95; 57/92

[58] Field of Search ..... 57/58.89–58.95, 57/92, 34 R, 104, 105

[56] References Cited

U.S. PATENT DOCUMENTS

| | | | |
|---|---|---|---|
| 3,375,649 | 4/1968 | Bures et al. | 57/58.91 |
| 3,511,045 | 5/1970 | Bures et al. | 57/58.91 |
| 3,756,007 | 9/1973 | Bartling | 57/58.91 |
| 3,802,176 | 4/1974 | Stahlecker | 57/105 |
| 3,874,154 | 4/1975 | Stahlecker et al. | 57/58.95 |
| 3,884,027 | 5/1975 | Schumann et al. | 57/58.95 X |

*Primary Examiner*—John Petrakes
*Attorney, Agent, or Firm*—Craig & Antonelli

[57] ABSTRACT

In order to permit an open-end spinning unit to be opened with a relatively small amount of force, there is a swivel lid which covers all parts, without these parts being attached thereto. However in order to enable the opener roller to be stopped when the open-end spinning unit is opened, the opener roller is located in a swivel housing, which swivels when the lid is opened, thereby interrupting the drive of the opener roller, as a wharve of the opener roller lifts away from a tangential belt.

26 Claims, 11 Drawing Figures

OPEN-END SPINNING UNIT

The present invention relates to an open-end spinning unit having a spinning rotor, supply means containing a supply roller and having opening means containing an opener roller driven by a tangential belt, the supply means and the opening means being arranged in planes which are parallel one to the other and being covered by a common, swivel lid having an insert with at least a portion of a fibre supply channel leading from the opener roller to the spinning rotor and a yarn removal channel leading out of the spinning rotor.

In a known design (German Disclosed Patent Application No. 2,029,878), a spinning rotor, an opener roller and a supply roller are arranged with parallel axes in a one-piece housing whose front side is closed by a common lid, which contains a fibre supply channel leading from the opener roller to the spinning rotor and a yarn removal channel leading out of the spinning rotor, which form a part of a detachable insert in an embodiment. The lid is mounted on the housing in a swivel manner, while the housing, in turn, is retained against the machine base in such a manner that it can swivel about an axis extending parallel to the swivel axis of the lid. If the lid in this design is opened, the housing is also swivelled, which causes the spinning rotor, the opener roller and the supply roller to lift away from their drives. This design permits a compact method of construction, which also provides good accessibility to the individual elements of the spinning unit. However relatively large masses must be moved in order to open the spinning unit, which makes handling difficult. Moreover, there are also problems in the area of the drive of the supply roller, which contains a friction clutch which opens when the common housing is swivelled away. In addition, with this design it is hardly possible to provide a cleaning possibility for the fibres in the area of the opener roller in actual practice, as this would be hindered by the spatial arrangement.

In a further known design (German Disclosed Patent Application No. 2,161,619), both the spinning rotor as well as the opener roller and the supply roller are arranged in a stationary manner. They are covered by a common lid, which contains an insert containing a portion of the fibre supply channel and the yarn removal channel. The supply roller and the opener roller are located in a plane which is perpendicular to the axis of the spinning rotor. The opener roller is driven by a central drive shaft via a single belt. Advantageous in this design is the fact that only relatively small masses have to be moved to open the spinning unit, as the supply roller and the opener roller are arranged in a stationary manner. In addition, this design also provides the advantage that cleaning means for the fibres, which do not have to operate with suction, can be attached quite well. However difficulties result with this design since the opener roller must also be stopped when the lid is opened. Transmission means are provided which transmit the opening motion of the lid to the tensioning elements of the belt drive of the opener roller in such a manner that the drive can be relieved or stopped. The aforementioned transmission means necessitate additional expense and complication. Difficulties also result in the area of the transition from that portion of the fibre supply channel belonging to the housing of the opener roller to that portion of the fibre supply channel located in the insert of the lid, as the latter should be aligned precisely relative to the spinning rotor for reasons of spinning technology, so that it is possible for a gap, which would impair the transport of the fibres, to form between the two parts.

It is also known practice (German Disclosed Patent Application No. 2,012,278) to arrange the supply and opening means in one common housing, which can be swivelled away from the housing of the spinning rotor, which is arranged in a stationary manner. With this design, also, relatively large masses have to be moved to open the spinning unit, while the opener roller and/or the supply roller are not accessible. In this design, also, it is virtually impossible to provide cleaning means providing effective, non-pneumatic removal of the impurities, in the area of the opener roller.

And finally, it is also known practice (German Disclosed Patent Application No. 2,200,686) to arrange the opener roller in a swivel housing which simultaneously forms a lid for the housing of the spinning rotor, which is arranged in a stationary manner. Moreover, the lid with the opener roller is also movable relative to the supply roller, which is arranged in a stationary manner and which is protected by a cover attached to the housing of the opener roller. This cover must be removed before the spinning unit is opened. In this design, also, relatively large masses have to be moved to open the spinning unit, with handling being made even more difficult since the cover of the supply roller must be removed prior to opening the spinning unit.

It is the object of the present invention to create an open-end spinning unit of compact design which can be opened without having to move large masses, which results in good accessibility of the individual elements, while the design of the drives and the bearing means for the spinning rotor and the supply roller are not impaired.

According to the present invention, this object is solved in that the opener roller is located in an independent housing, which can be swivelled relative to the stationary-mounted spinning rotor and the stationary-mounted supply roller for interrupting the drive, the housing being retained in the operating position of the closed lid.

The present invention results in a compact design for the entire open-end spinning unit, in which an uncomplicated tangential belt drive is provided for the opener roller. Since it can be ensured that neither the spinning rotor nor the supply roller are moved when the spinning unit is opened, the most favourable drives and bearing means can be selected for each of these two elements. Since the opener roller and its housing must only move slightly, there is no difficulty in attaching cleaning means having stationary conveying means for removal of the impurities.

Advantageous further developments and embodiments of the present invention are described below.

Through a further development, the insert of the lid, containing the mouth of the fibre supply channel and the yarn removal channel, can be aligned precisely relative to the spinning rotor, while still not impairing the fibre transport between the housing of the opener roller and the insert, as the housing of the opener roller aligns and centers itself on the insert when the lid is closed.

Through a further development with the housing for the lid being pivoted about an axis parallel to the tangential drive belt for the opener roller and perpendicular to the pivot axis for the housing of the opener roller, it is possible for the housing of the opener roller to be able to move after only minimum swivel of the lid, as these two movements can be performed in directions which vary one from the other. An especially advantageous development of the invention results from arranging the opener roller housing pivot axis coaxially to the supply roller axis. This provides the advantage that no special pivotal axle is required for the housing of the opener roller on the one hand, while it is very simple, from a production-technology standpoint, to maintain a precise clearance between the supply roller and the opener roller, on the other hand.

The development with the housing of the opener roller subjected to a load with elastic means which press the housing against a stop of the lid when the lid is closed permits a very precise transition between the two portions of the fibre supply channel, as the insert of the lid and the housing of the opener roller must be able to align themselves very precisely one relative to the other when the unit is closed.

Through a further development with a pressure finger on the lid cooperating with a stop surface of the opener roller housing, it is possible to permit larger swivel movements of the housing of the opener roller when the unit is opened, as the pressure finger initiates the movement of the housing of the opener roller in the operating position. Moreover, with the aid of a pressure finger of this type it is possible to create locking means. Since the lid is usually fabricated as a sheet-metal stamping, it is advantageous to also provide this development, as lateral arresting is then possible.

Since the lid and the insert of the lid detach themselves completely from the housing of the opener roller when the unit is opened, it is practical to also provide locking means between the lid and this housing.

If the housing of the opener roller can be pivoted about the axis of the supply roller, a further development with the supply roller mounted on a housing for the spinning rotor offers design advantages. The development with the supply roller mounted on carrier rigidly connected with a housing for the spinning rotor also provides the advantage that the clamping point between the supply roller and the load-producing means remains, even when the unit is opened, and that there is no sliver delay caused by the movement of the housing, so that there is no danger of clogging, even when the spinning operation is started again.

The development with the carrier of the supply roller also carrying a pivotal axle of the lid is advantageous if the function of the drive of the opener roller is to be checked while the spinning unit is opened. The additional locking means hold the housing of the opener roller at least in such a position that its drive is maintained.

The above discussed and other objects, features and advantages of the present invention will become more apparent from the following description thereof, when taken in connection with the accompanying drawings, in which FIG. 1 shows a vertical section through an open-end spinning unit according to the present invention, in the closed state;

Figure 1:
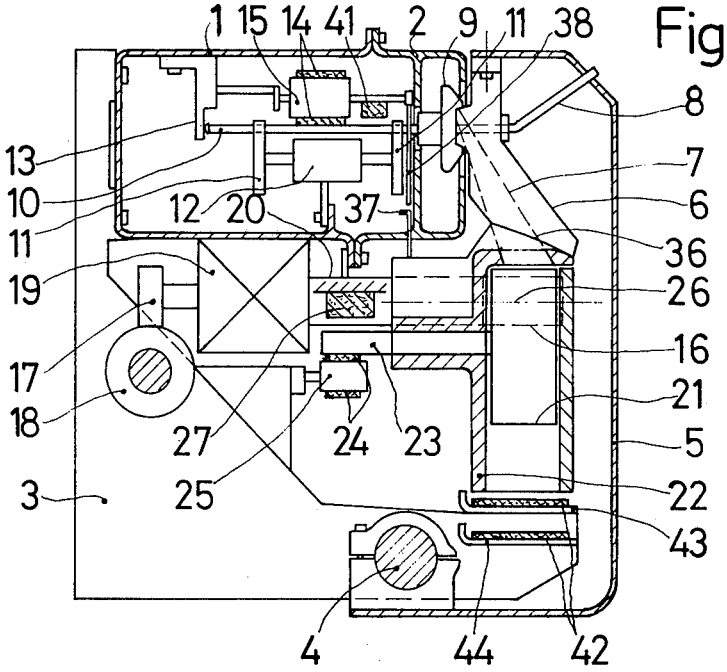
Figure 2:
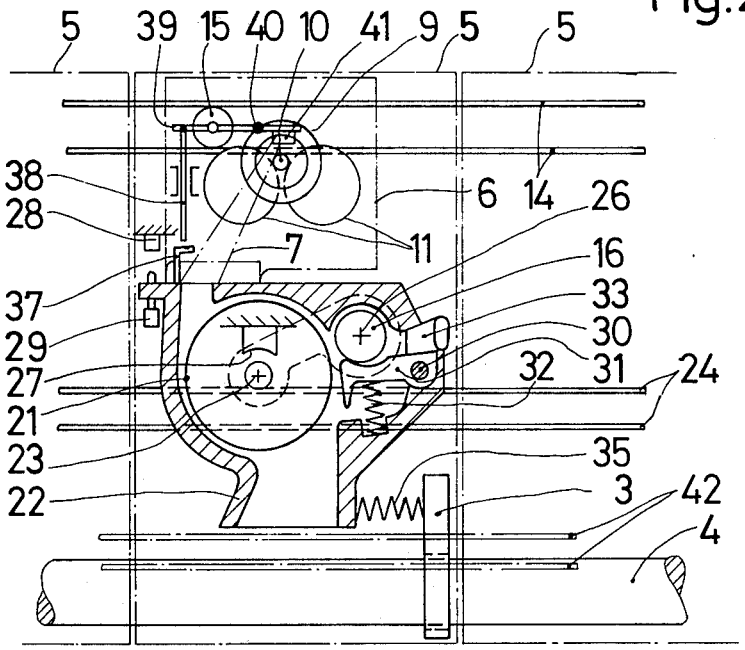
FIG. 2 shows a front view of the spinning unit according to FIG. 1, with the lid only suggested by a dash-dotted line.

Referring now to the drawings, wherein like reference numerals designate like parts throughout the several views, the open-end spinning unit illustrated in FIGS. 1 to 4 has a stationary rotor housing, comprising parts 1 and 2, which forms a channel extending longitudinally through the machine. Arranged in the housing is a spinning rotor 9, whose shaft 10 is mounted in a wedge formed by a pair of support rollers 11. Support rollers 11 are mounted in bodies 12. Axially, shaft 10 of spinning rotor 9 is in a supporting relationship with a step bearing 13, since an axial component of force is exerted against it in this direction. Shaft 10 is driven by means of a tangential belt 14, which is subjected to a load in the direction of shaft 10 by pressure pulleys 15. Pressure pulleys 15 guide both the top and bottom of tangential belt 14.

Opened fibres are supplied to spinning rotor 9. To accomplish this, a sliver is drawn in through a supply funnel 33 by a supply roller 16, which operates conjointly with a supply table 31. Supply table 31 is mounted pivotally on an axle 30 and pressed against supply roller 16 by means of a spring 32. These supply means offer the sliver to an opener roller 21 in the form of a fibre tuft; opener roller 21, which rotates significantly faster, separates the fibres and supplies them to the spinning rotor, with this supplying operation being supported by an airstream produced by an underpressure.

Supply roller 16 is, in an unillustrated manner, mounted in a carrier 20, which is attached to the bottom of rotor housing 1, 2, and is driven via two helical gears 17 and 18 by means of a longitudinal shaft extending longitudinally through the machine in the vicinity of the back of rotor housing 1, 2. Arranged between supply roller 16 and helical gear 17 is an electromagnetic clutch 19, which is opened by an unillustrated thread stop-motion in the event of a thread break to order to interrupt the supply of fibres.

Opener roller 21 is mounted in a housing 22. Outside the housing, it has a wharve 23, which is driven by a tangential belt 24 extending in the longitudinal direction of the machine, with both top and bottom being guided on pulleys 25. In the area beginning at the supply roller 16 and supply table 31, housing 22 of opener roller 21 has an opening of relatively large cross section at the bottom, through which impurities can be removed. Located beneath this opening is a conveyor belt 42, which extends in the longitudinal direction of the machine and transports the removed impurities away.

Provided between housing 22 of opener roller 21 and the front of rotor housing 1, 2 is an insert 6, which protrudes into the spinning rotor and seals off its housing from the outside. This insert 6 contains a portion of a fibre supply channel 7 leading from opener roller 21 to spinning rotor 9 and a yarn removal channel 8 leading out of spinning rotor 9.

The front of the entire spinning unit is covered by a common lid 5, to which insert 6 is adjustably mounted in such a manner that it can be aligned precisely relative to the spinning rotor. Lid 5 is mounted on a pivotal axle 4, which extends through the machine longitudinally, as can be seen from FIGS. 2 and 4. This pivotal axle 4 is supported in a plurality of locations by supports 3, which are attached to the back of rotor housing 1, 2. The aforesaid support 3 also has guide members 43 and 44, which guide conveyor belt 42. In the same manner as all drive means extending through the machine, i.e. tangential belt 14, tangential belt 24, the shaft with helical gears 18 and conveyor belt 42, pivotal axle 4 extends in the longitudinal direction of the machine, while the parts driven thereby, spinning rotor 9, opener roller 21 and supply roller 16, are arranged axially parallel one to the other in planes extending at right angles thereto.

Supply roller 16 and spinning rotor 9 are mounted in a stationary manner in stationary bearing means, while housing 22 is pivotally arranged together with opener roller 21, with this swivel motion being employed to interrupt both the drive of opener roller 21 and the drive of spinning rotor 9. In the illustrated embodiment, housing 22 of the opener roller is mounted coaxially to axis 26 of supply roller 16, thereby permitting it to swivel in a plane which is perpendicular to the plane of swivel of lid 5. Lid 5, and its insert 6, serve to secure housing 22 in its operating position, while after the lid is opened it automatically swivels into a position in which wharve 23 is lifted away from tangential belt 24 and is also in a contacting relationship with a stationary brake lining 27. The swivel motion is produced by a compression spring 35, arranged between housing 22 and support 3. If there is not one support 3 for each spinning unit, stops can be provided on pivotal axle 4, with spring 35 of the corresponding spinning unit being in a supporting relationship therewith. The swivel motion of housing 22 is additionally limited by a stationary stop 28, to which an adjusting screw 29, which stipulates the maximum swivel, is associated. A pusher 37 attached to housing 22 transmits the swivel motion to a push rod 38 located in the rotor housing, push rod 38 being connected with a lever 39 on which the pressure pulley 15 of tangential belt 14 is arranged. This lever 39 is pivotally mounted about an axle 40. It extends beyond axle 40 and has a brake lining 41, which lowers onto shaft 10 of spinning rotor 9 when push rod 38 is lifted.

Since insert 6 must be aligned as precisely as possible relative to the spinning rotor, it is advantageous for the aforementioned insert 6 to also stipulate the operating position of housing 22, and thus of opener roller 21, as coincidence of the two parts of fibre supply channel 7 can then be dependably ensured. For this purpose, insert 6 and housing 22 have mutually corresponding guide surfaces 36 which slide one on the other when lid 5 is closed, thereby causing housing 22 to swivel into the operating position against the effect of compression spring 35. In the operating position, spring 35 then presses guide surfaces 36 together elastically in such a manner that additional elastic sealing means are not required. This elastic sealing force is also supported by the belt tension of tangential belt 24. In order for the two guide surfaces to only have to perform small laterally sliding motions one relative to the other, it is practical for the swivel axis of housing 22, i.e. in the embodiment according to FIGS. 1 to 4 axis 26 of supply roller 16, to be located at least approximately at the height of guide surface 36 of housing 22 when it assumes its operating position.

Figure 3:
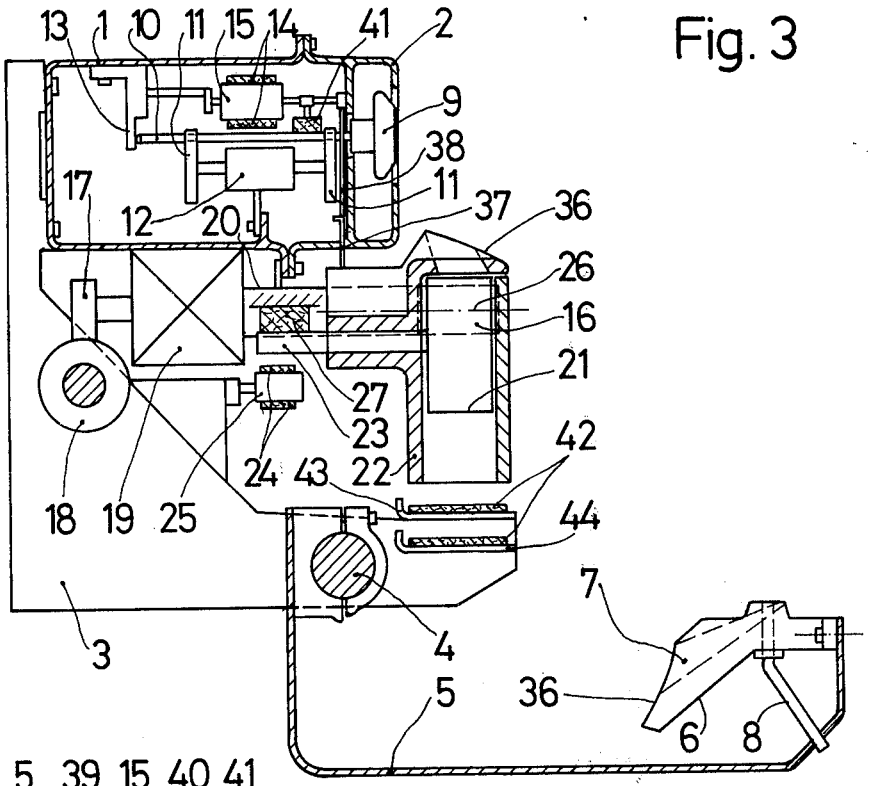
FIG. 3 shows a section, similar to that in FIG. 1, through the opened spinning unit.
Figure 4:
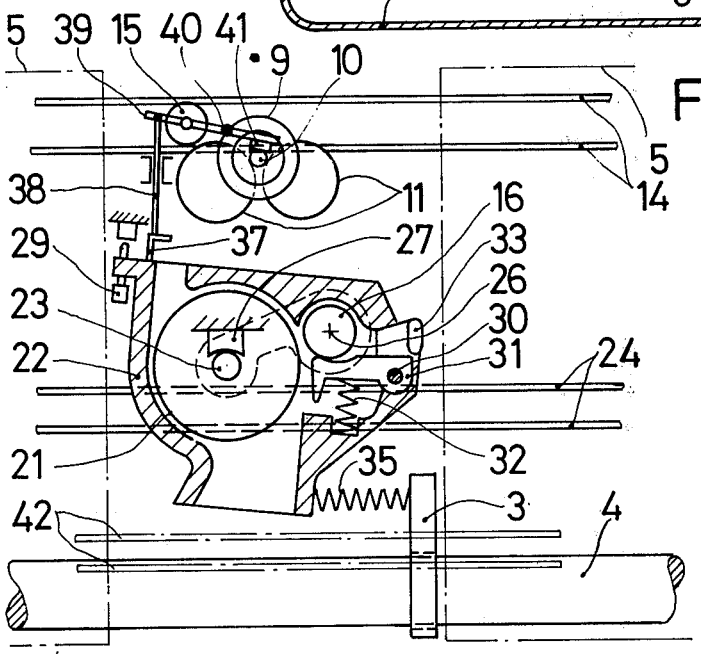
FIG. 4 shows a front view of the spinning unit, in the opened state, without lid.

As can be seen from FIGS. 3 and 4 in particular, spinning rotor 9, supply roller 16, opener roller 21 and conveyor belt 42 are easily accessible by opening the lid. Lid 5, with its insert 6, has only a relatively low mass, thereby permitting it to be swivelled with a minimum of force. Only for closing the lid, and swivelling housing 22 into its operating position, are somewhat greater forces required, which are also a factor of the design of guide surfaces 36, which must be designed in such a manner as to produce the greatest possible component of force in the peripheral direction of the swivel axis of housing 22.

Figure 5:
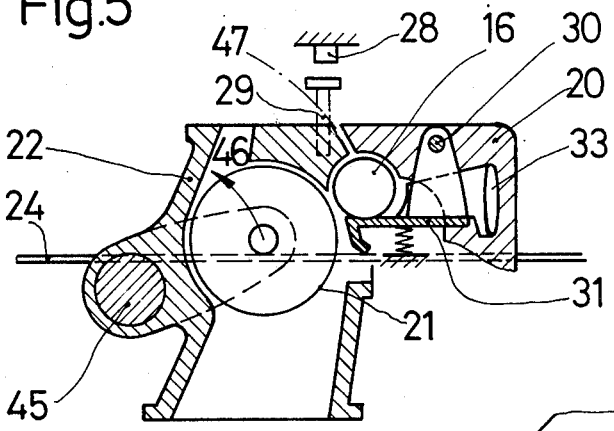
FIG. 5 shows a section through an altered development of a detail of an open-end spinning unit according to the present invention.

FIG. 5 shows a design of a detail, in which the swivel axis of housing 22 for opener roller 21 is not supply roller 16, but an axle 45 parallel thereto. When unillustrated lid 5 is opened, housing 22 swivels in the direction of arrow 46 until the wharve of opener roller 21 comes into a contacting relationship with a brake shoe in the above-described manner. There is a stop 28 for reasons of safety, against which an adjustable screw 29 can come into a contacting relationship if necessary. As can be seen, if screw 29 is screwed in completely stop 28 has no effect whatsoever on the swivel motion of housing 22. The dash-dotted line 47 shows the swivel radius. In this manner, if the unillustrated brake shoe is removed, housing 22 with opener roller 21 can be swivelled a significantly greater angle, thereby permitting simplified disassembly.

Figure 6:
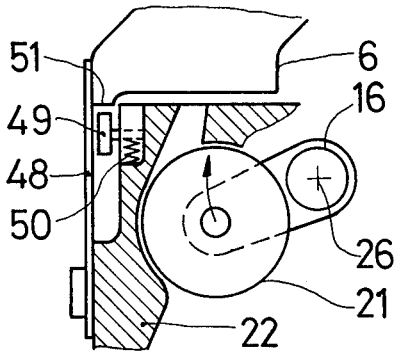
FIG. 6 shows a section through a further development of an open-end spinning unit similar to that shown in FIG. 1.
Figure 7:
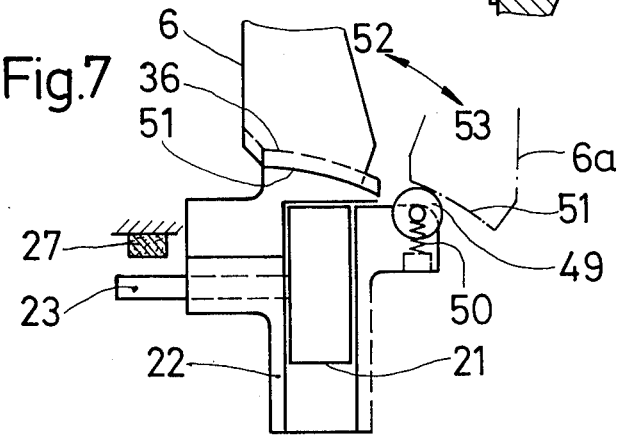
FIG. 7 shows a view of the detail of FIG. 6.

FIGS. 6 and 7 show an advantageous development of the guide surfaces between insert 6 of lid 5 and housing 22. Insert 6 has a pressure finger 51, which comes into a contacting relationship with a roller 49 when the unit is closed. Roller 49 is arranged on housing 22 of opener roller 21, and can be shifted vertically against the pressure of a spring 50. When lid 5 is closed in the direction of arrow 52, pressure finger 51 first comes into a contacting relationship with roller 49 (see dash-dotted representation **6*a* in FIG. 7). This simultaneously initiates the closing motion of housing 22. Housing 22 is then finally guided over surface 36 of insert 6. Lid 5 has lateral play. Insert 6 is centered laterally during closing by means of a leaf spring 48 arranged on housing 22**.

Figure 8:
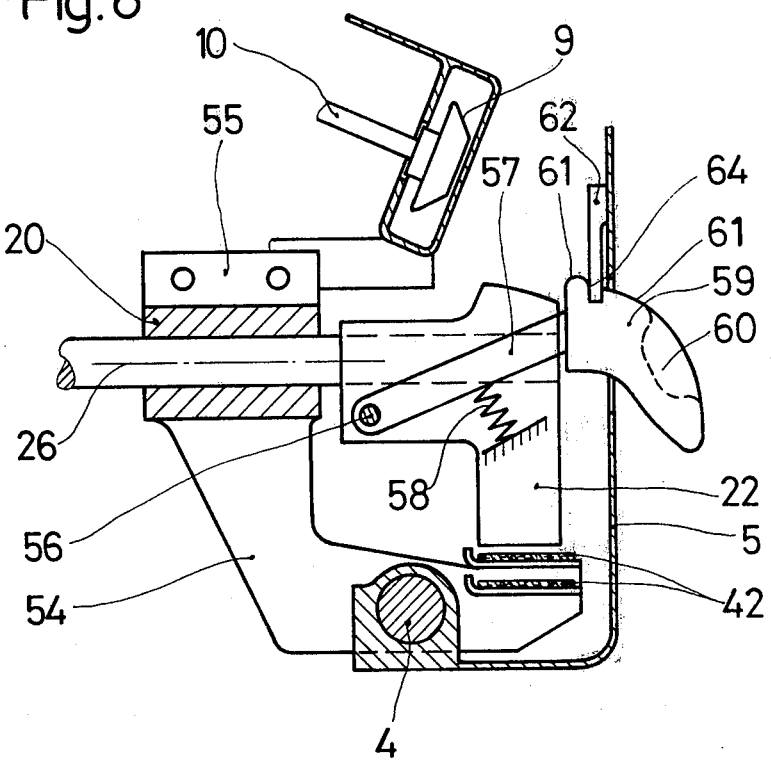
FIG. 8 shows the attachment of locking means between a lid and a housing of an opener roller.

FIG. 8 shows means for locking the spinning unit. In this example, pivotal axle 4 for lid 5, which can extend through a plurality of spinning points, is arranged on a carrier 54, which is connected with carrier 20 for guiding the axis 26 of supply roller 16. A flange 55 for attachment to the rotor housing can be provided on the aforementioned carrier 20. Housing 22, which can be pivoted about axis 26, has a bolt 56, about which a lever 59 can be pivoted against the pressure of a spring 58. The aforementioned lever 59 operates conjointly with a pusher 62 arranged on lid 5. To open the spinning unit, lever 59, having a recess 60, is pressed downwardly, thereby releasing the lock. This separates pusher 62 from lever 59. When the unit is closed, pusher 62 first slides against surface 61 and then engages edge 64. This permits easy locking. In the embodiment according to FIG. 8, it is suggested that shaft 10 of spinning rotor 9 can assume an inclination relative to the axis of the opener roller and axis 26 of the supply roller, whereby however the parts remain parallel as viewed from the top. The inclination between opener roller and spinning rotor 9 can be practical in order to design the fibre supply channel in an especially simple manner.

Figure 9:
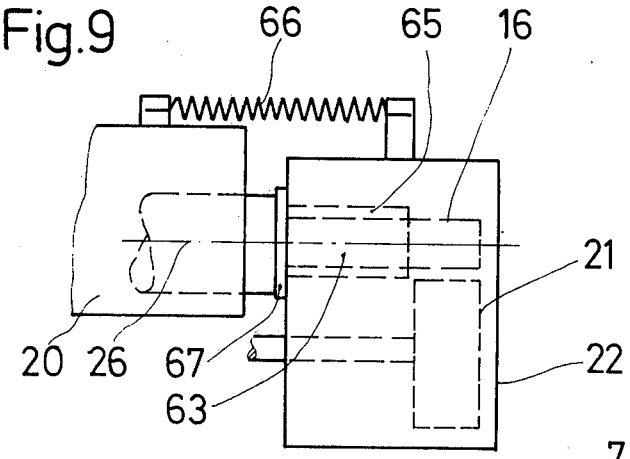
FIG. 9 shows a view of an example for the design of pivotal bearing means for a housing of the opener roller.

FIG. 9 shows an example of an easily removable arrangement of housing 22 of opener roller 21 on its pivotal axis 26. For this purpose, a shaft section 63, on which a bearing 65 of housing 22 is pushed, has a somewhat larger diameter than supply roller 16, thereby permitting housing 22 to be removed easily toward the front. A tension spring 66, which is connected with housing 22 on the one hand and with stationary carrier 20 on the other, fixes housing 22 in its axial position by bringing it into a contacting relationship with spacer washers 67, which permit precise axial adjustment. The force of spring 66 can be selected in such a manner that it can also perform the function of the above-described spring 35, which causes housing 22 to swivel. Housing 22 can easily be removed from axis 26 after spring 66 has been detached.

Figure 10:
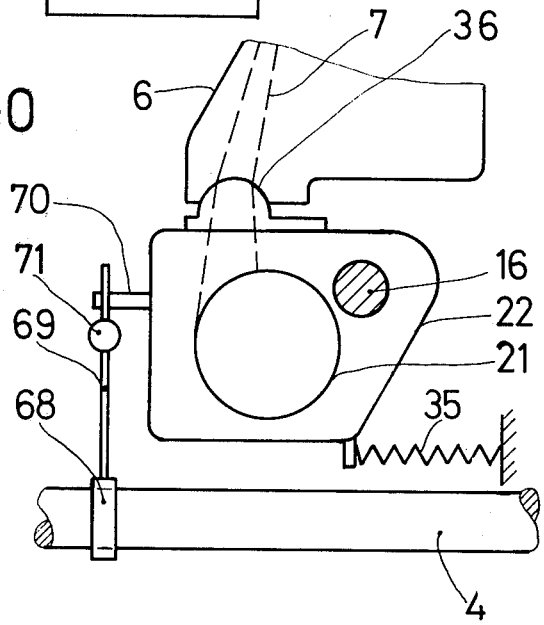
FIG. 10 shows a detail of an open-end spinning unit according to the present invention, having locking means for the housing of the opener roller which are independent of the lid.
Figure 11:
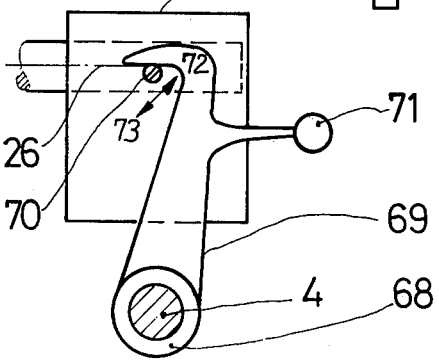
FIG. 11 shows a side view of the embodiment according to FIG. 10.

FIGS. 10 and 11 show a housing 22 for opener roller 21 which can be locked and moved independently of the swivel motion of lid 5, with all parts being left away which are not of significance for the method of operation described below. In the unlocked state, housing 22 can pivot about axis 26, which can be coaxial to the supply roller for example, under the effect of spring 35. For locking housing 22, there is a lever 69, having a handle 71, with the swivel bearing 68 of lever 69 being arranged on pivotal axle 4 for unillustrated lid 5. During initial assembly, with the locking means open, housing 22 and its guide surface 36 are automatically aligned with lid 5, as described above, during the closing operation. Locking lever 69 is then closed, with the locking bolt 70 attached to housing 22 being adjusted, by being shifted in direction 72 or 73, in such a manner that housing 22 subsequently assumes precisely the same position when locking lever 69 is actuated, even if lid 5 is open. Thus, it is possible to open lid 5 without swivelling housing 22. Only after lever 69 has also been actuated is it possible to swivel housing 22, thereby stopping opener roller 21 and spinning rotor 9. With this arrangement, it can be practical for rotor brake 41 not to be actuated by the movement of housing 22, but directly by the movement of lid 5 by means of a different transmission system. FIG. 10 also shows an advantageous design of guide surfaces 36, which provides precise centering. This is accomplished by means of a groove with a generally semicircular cross section machined into insert 6 and serving as guide surface 36, to which the correspondingly designed guide surface 36 of housing 22 is associated. In the illustrated embodiment, this guide surface is formed by a guide member attached to housing 22.

In all types of embodiments, there are two basic possibilities for attaching supply table 31. This table can either be arranged on housing 22 for opener roller 21 or however, as shown in FIG. 5, on carrier 20 for supply roller 16. The latter embodiment ensures a constant clamping point between supply table 31 and supply roller 16 when the spinning unit is opened, as table 31 does not perform the swivel movement of housing 22 in this case.

Since the drives of the supply roller and of the spinning rotor are not influenced by the development according to the present invention, especially suitable drives can be selected herefor, which can also be designed in accordance with other considerations. In particular, it is possible to select a different drive mode and different bearing means for the spinning rotor, for example a direct drive with electric motors and/or air-cushion bearings.

Obviously, many modifications and variations of the present invention are possible in the light of the above teachings. It should therefore be understood that within the scope of the appended claims, the invention may be practiced otherwise than as specifically described.

Having thus fully disclosed my invention, what I claim is:

1. An open-end spinning unit comprising:

spinning rotor means for spinning fiber material supplied thereto, opener roller means for opening fiber material supplied to the spinning rotor means, opener roller drive means for driving said opener roller means, a common lid covering said spinning rotor means and said opener roller means, said common lid being movable between a closed operating position and an open non-operating position, and opener roller housing means carrying said opener roller means, said opener roller housing means being movable with respect to said spinning rotor means between a driving position with said opener roller means in driving engagement with said opener roller drive means and a non-driving position with said opener roller means out of driving engagement with said opener roller drive means, said common lid being operable to hold said opener roller housing means in said driving position when said common lid is in said closed operating position.

2. The open-end spinning unit according to claim 1, further comprising locking means separate from said common lid for releasably locking said opener roller housing means in said driving position independently of the position of said common lid.

3. The open-end spinning unit according to claim 1, further comprising:

supply roller means for supplying fiber material to said opener roller means, and an insert attached to said common lid and having a portion of a fiber supply channel leading from said opener roller means to said spinning rotor means and a yarn removal channel leading out of said spinning rotor means, wherein said spinning rotor means and said supply roller means are arranged in a stationary manner with said opener roller housing means movable relative thereto.

4. The open-end spinning unit according to claim 3, wherein said opener roller drive means is a tangential belt.

5. The open-end spinning unit according to claim 4, in which the common lid and the insert are in a contacting relationship with the opener roller housing means when said common lid is in the closed operating position, with said insert being attached to said common lid in such a manner that it is adjustable relative to said spinning rotor means.

6. The open-end spinning unit according to claim 5, in which there are guide means, which act at right angles to the swivel direction of the said common lid, between the opener roller housing means and the insert of the common lid.

7. The open-end spinning unit according to claim 4, in which an axis about which the opener roller housing means is pivotally mounted is located in a plane which extends perpendicular to an axis which is located parallel to the direction of the tangential belt and about which the common lid can be pivoted.

8. The open-end spinning unit according to claim 7, in which the axis of the opener roller housing means is located parallel to the axis of the opener roller means.

9. The open-end spinning unit according to claim 7, in which the axis of the opener roller housing means is arranged coaxially to the axis of the supply roller means.

10. The open-end spinning unit according to claim 9, in which the opener roller housing means at least partially surrounds the supply roller means.

11. The open-end spinning unit according to claim 10, in which load-providing means which are associated to the supply roller means are arranged on the opener roller housing means.

12. The open-end spinning unit according to claim 10, in which load-providing means associated to the supply roller means are retained in a stationary manner on a member supporting the supply roller means.

13. The open-end spinning unit according to claim 4, in which the insert of the common lid has a guide surface which operates conjointly with a corresponding guide surface of the opener roller housing means when the common lid is in the closed operating position.

14. The open-end spinning unit according to claim 13, in which the opener roller housing means is subjected to a load with elastic means which press said opener roller housing means against a stop of the common lid when said common lid is located in the closed operating position.

15. The open-end spinning unit according to claim 13, in which the common lid is equipped with a pressure finger, to which pressure finger a stop surface of the opener roller housing means is associated.

16. The open-end spinning unit according to claim 4, in which the common lid is equipped with a pressure finger, to which pressure finger a stop surface of the housing of the opener roller is associated.

17. The open-end spinning unit according to claim 4, in which there are locking means between the opener roller housing means and the common lid.

18. The open-end spinning unit according to claim 4, in which there are stationary stop means in order to limit swivel movement of the opener roller housing means.

19. The open-end spinning unit according to claim 18, in which the stop means are attached in an adjustable manner.

20. The open-end spinning unit according to claim 18, in which the stop means are attached in a detachable manner.

21. The open-end spinning unit according to claim 4, in which the opener roller housing means is detachably arranged, in the axial direction, on its pivot axle.

22. The open-end spinning unit according to claim 21, in which the opener roller housing means is secured on the axle through elastic means which press said opener roller housing means against a spacer washer.

23. The open-end spinning unit according to claim 4, in which the supply roller means is mounted on a housing of the spinning rotor means.

24. The open-end spinning unit according to claim 4, in which the supply roller means is mounted on a carrier which is rigidly connected with a housing of the spinning rotor means.

25. The open-end spinning unit according to claim 24, in which the carrier of the supply roller means also carries a pivotal axle of the common lid.

26. The open-end spinning unit according to claim 4, in which there are locking means which retain the opener roller housing means in the driving position, independently of the position of the common lid.

* * * * *